US011523196B1

(12) United States Patent
Roe

(10) Patent No.: US 11,523,196 B1
(45) Date of Patent: Dec. 6, 2022

(54) TWO WAY COMMUNICATION ASSEMBLY

(71) Applicant: Keith Roe, Bakersfield, CA (US)

(72) Inventor: Keith Roe, Bakersfield, CA (US)

( * ) Notice: Subject to any disclaimer, the term of this patent is extended or adjusted under 35 U.S.C. 154(b) by 0 days.

(21) Appl. No.: 17/495,181

(22) Filed: Oct. 6, 2021

(51) Int. Cl.
*H04R 1/02* (2006.01)
*H04R 5/027* (2006.01)

(52) U.S. Cl.
CPC ..... *H04R 1/025* (2013.01); *H04R 1/026* (2013.01); *H04R 5/027* (2013.01)

(58) Field of Classification Search
CPC ..... H04R 1/025; H04R 1/026; H04R 5/027
See application file for complete search history.

(56) References Cited

U.S. PATENT DOCUMENTS 4,894,858 A 1/1990 Collingwood
5,309,510 A 5/1994 Berndt
5,384,838 A 1/1995 Hoffman
6,256,479 B1 7/2001 Hoffmann
6,560,345 B1 * 5/2003 Hachisuka ..... H04R 17/02 381/354
D496,023 S 9/2004 Gubbels
10,284,703 B1 * 5/2019 Lawrence ..... H04M 1/72412
11,064,168 B1 * 7/2021 Beach ..... H04N 5/2253

FOREIGN PATENT DOCUMENTS

WO WO9005433 5/1990

* cited by examiner

*Primary Examiner* — Andrew L Sniezek

(57) ABSTRACT

A two way communication assembly includes a first puck that is positionable on a first surface of a partition. A first microphone is integrated into the first puck to capture spoken words from a first user. A first speaker is disposed in the first puck to emit audible sounds outwardly from the first puck. A second puck is positionable on a second surface of the partition. A second microphone is integrated into the second puck to capture spoken words from a second user. Moreover, the first speaker audibly emits words spoken by the second user. A second speaker is disposed in the second puck to emit audible sounds outwardly from the second puck. Additionally, the second speaker audibly emits words spoken by the first user.

10 Claims, 5 Drawing Sheets

TWO WAY COMMUNICATION ASSEMBLY

(b) CROSS-REFERENCE TO RELATED APPLICATIONS

Not Applicable

(c) STATEMENT REGARDING FEDERALLY SPONSORED RESEARCH OR DEVELOPMENT

Not Applicable

(d) THE NAMES OF THE PARTIES TO A JOINT RESEARCH AGREEMENT

Not Applicable

(e) INCORPORATION-BY-REFERENCE OF MATERIAL SUBMITTED ON A COMPACT DISC OR AS A TEXT FILE VIA THE OFFICE ELECTRONIC FILING SYSTEM.

Not Applicable

(f) STATEMENT REGARDING PRIOR DISCLOSURES BY THE INVENTOR OR JOINT INVENTOR

Not Applicable

(g) BACKGROUND OF THE INVENTION

(1) Field of the Invention.

The disclosure relates to communication devices and more particularly pertains to a new communication device for facilitating two people to verbally communicate through a partition. The device includes a first puck which includes a first microphone, a first speaker and a magnet that is attached to the first puck. The device includes a second puck which includes a second microphone, a second speaker and magnetic plate that is attached to the second puck. The first puck and the second puck are positionable on opposite sides of a partition such that the magnet magnetically engages the magnetic plate. The first speaker emits words that are captured by the second microphone and the second speaker emits words that are captured by the first microphone. Additionally, each of the first puck and the second puck includes an induction coil such that the first puck transmits electrical power to the second puck.

(2) Description of Related Art including information disclosed under 37 CFR 1.97 and 1.98.

The prior art relates to communication devices including a double sided speaker device that includes a support for suspending the device on a vehicle window to facilitate a driver to verbally communicate with a person without rolling down their window. The prior art discloses a variety of communication devices that are attachable to an upper edge of a door to facilitate two people to communication through the door. In each instance the communication devices are electrically connected together with a conductor. The prior art discloses a wireless intercom device with employs Bluetooth technology.

(h) BRIEF SUMMARY OF THE INVENTION

An embodiment of the disclosure meets the needs presented above by generally comprising a first puck that is positionable on a first surface of a partition. A first microphone is integrated into the first puck to capture spoken words from a first user. A first speaker is disposed in the first puck to emit audible sounds outwardly from the first puck. A second puck is positionable on a second surface of the partition. A second microphone is integrated into the second puck to capture spoken words from a second user. Moreover, the first speaker audibly emits words spoken by the second user. A second speaker is disposed in the second puck to emit audible sounds outwardly from the second puck. Additionally, the second speaker audibly emits words spoken by the first user.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

(i) BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

(j) DETAILED DESCRIPTION OF THE INVENTION

Figure 1:
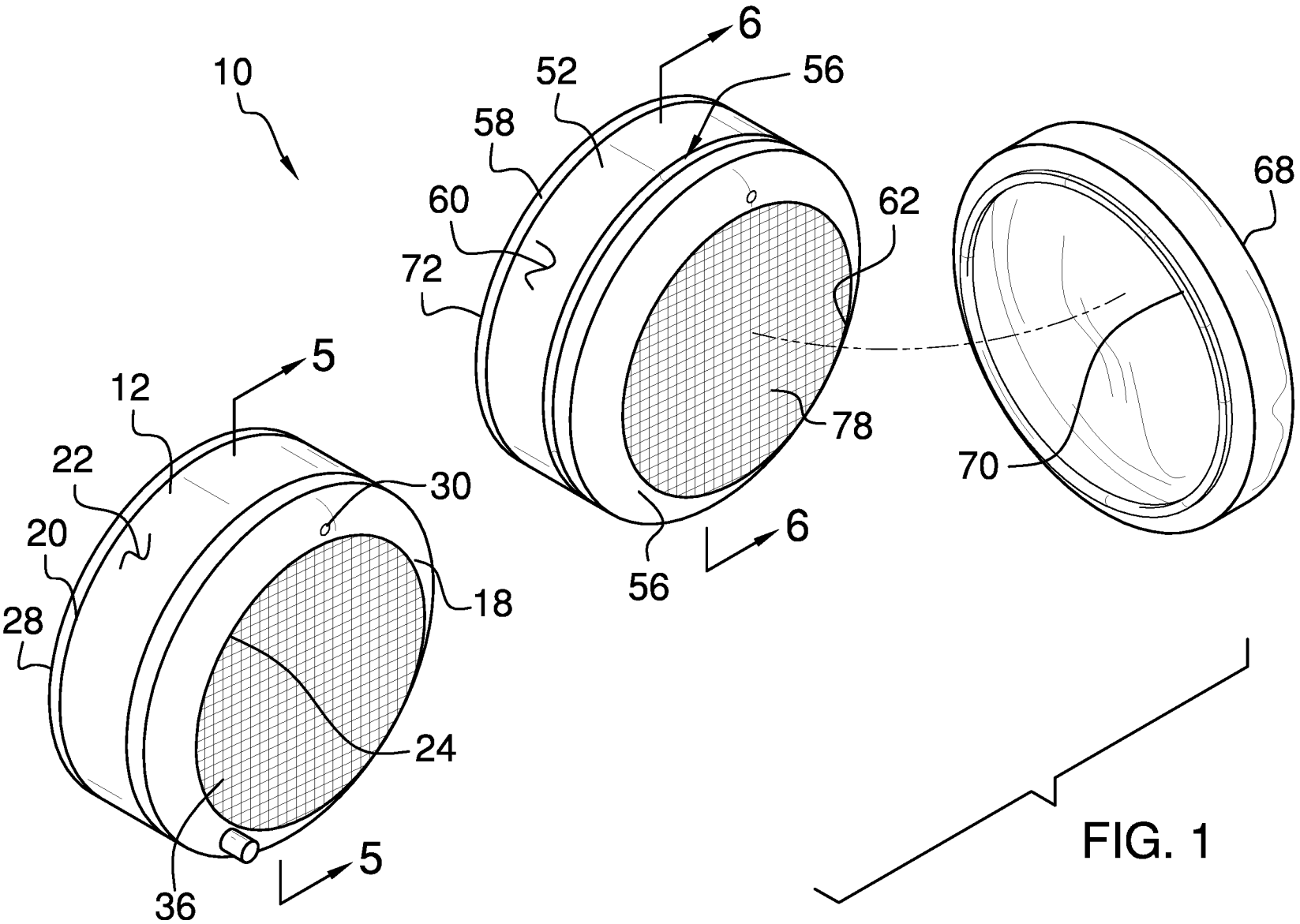
FIG. 1 is a perspective view of a two way communication assembly according to an embodiment of the disclosure.
Figure 2:
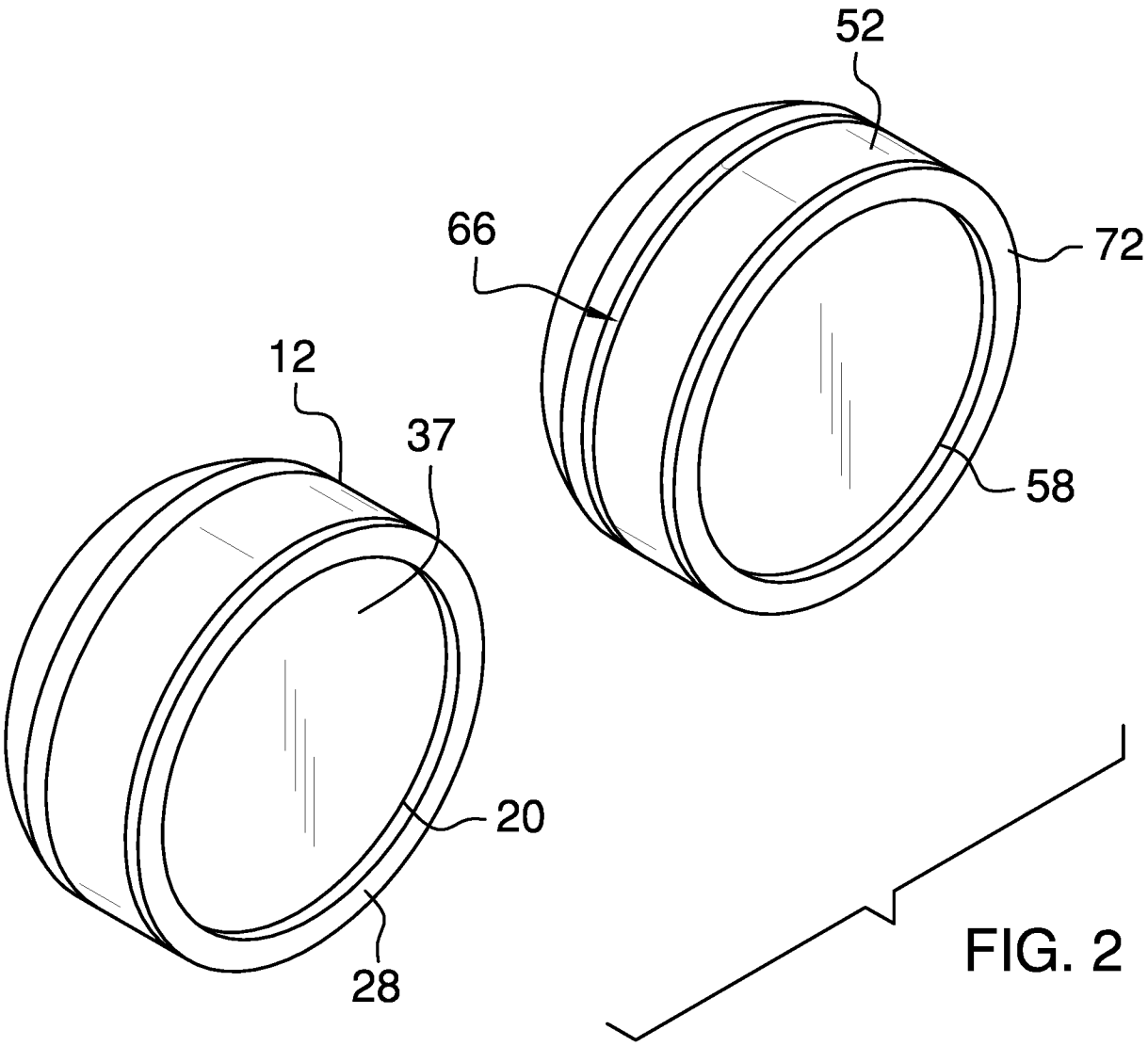
FIG. 2 is a back perspective view of an embodiment of the disclosure.
Figure 3:
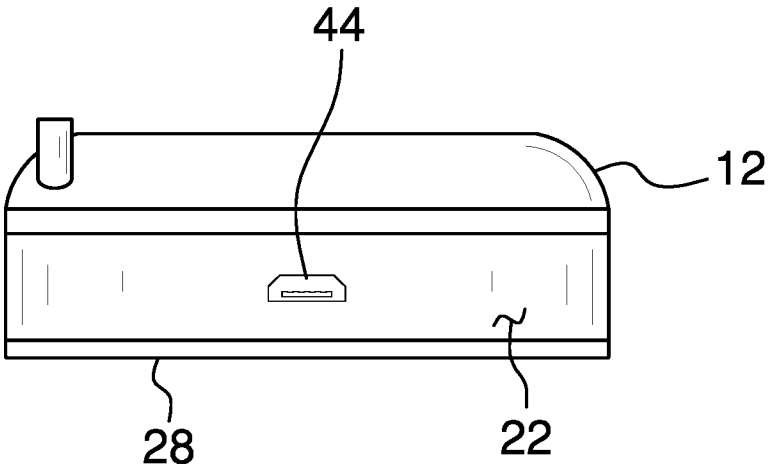
FIG. 3 is a bottom view of a first puck of an embodiment of the disclosure.
Figure 4:
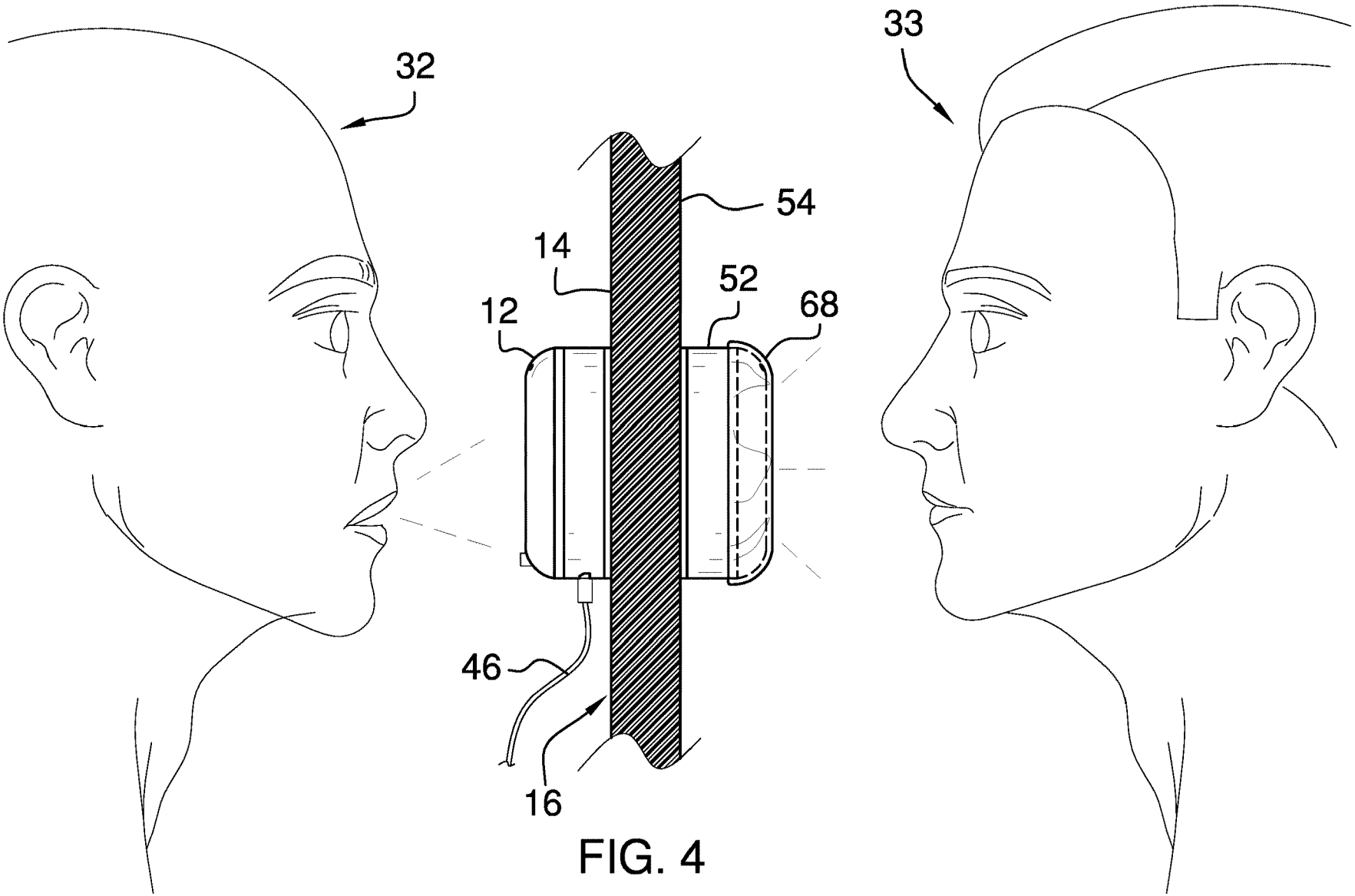
FIG. 4 is a perspective in-use view of an embodiment of the disclosure.
Figure 5:
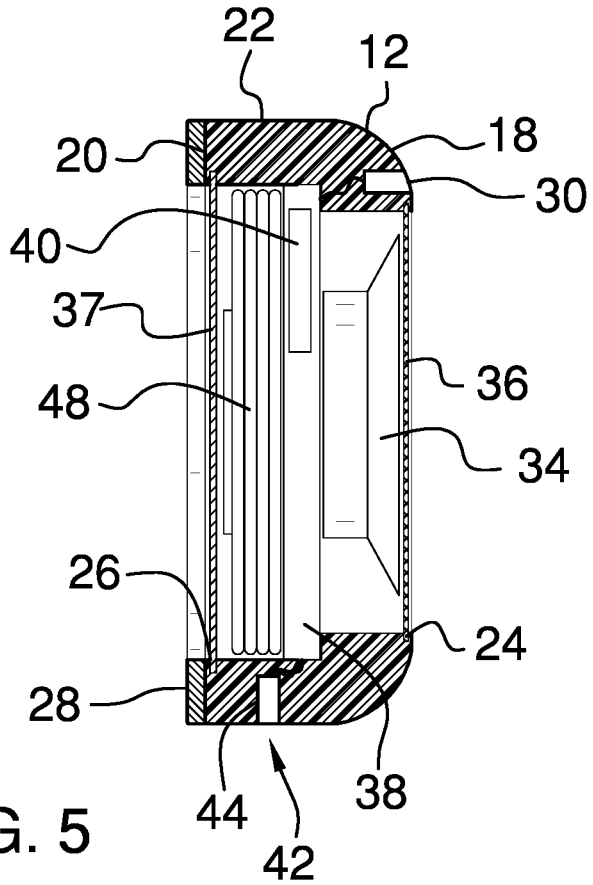
FIG. 5 is a cross sectional view taken along line 5-5 of FIG. 1 of an embodiment of the disclosure.
Figure 6:
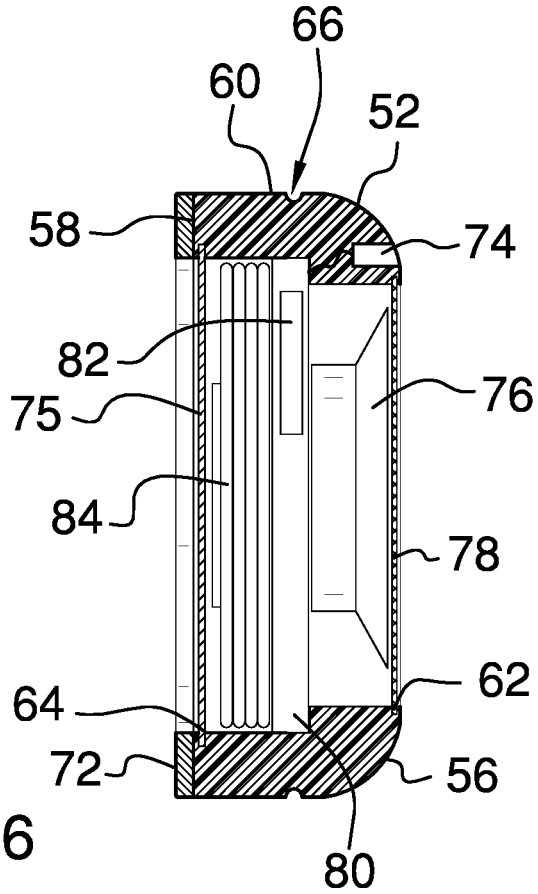
FIG. 6 is a cross sectional view taken along line 6-6 of FIG. 1 of an embodiment of the disclosure.

With reference now to the drawings, and in particular to FIGS. 1 through 6 thereof, a new communication device embodying the principles and concepts of an embodiment of the disclosure and generally designated by the reference numeral 10 will be described.

As best illustrated in FIGS. 1 through 6, the two way communication assembly 10 generally comprises a first puck 12 that is positionable on a first surface 14 of a partition 16. The first puck 12 has a front side 18, a back side 20 and a perimeter surface 22 extending between the front side 18 and the back side 20. The first puck 12 is substantially hollow, the front side 18 has a front opening 24 extending into an interior of the first puck 12 and the back side 20 has a back opening 26 extending into the interior of the first puck 12. The partition 16 may be a translucent panel, such as Plexiglas or the like, that is employed for reducing the airborne transmission of infectious diseases between a first user 32 and a second user 33.

A magnet 28 is coupled to the first puck 12 such that the magnet 28 abuts the first surface 14 of the partition 16 when the first puck 12 is positioned against the first surface 14. The magnet 28 is positioned on the back side 20 and the magnet 28 is continuous such that the magnet 28 surrounds the back opening 26. A first microphone 30 is integrated into the first puck 12 to capture spoken words from the first user 32. The first microphone 30 is integrated into the front side 18 of the first puck 12. Additionally, the first microphone 30 may comprise an electronic microphone or the like.

A first speaker 34 is disposed in the first puck 12 to emit audible sounds outwardly from the first puck 12 and the first speaker 34 is positioned in the interior of the first puck 12. The first speaker 34 is directed toward the front opening 24 in the front side 18 to emit audible sounds outwardly through the front opening 24 thereby facilitating the first user 32 to hear the audible sounds. A first screen 36 is coupled to the front side 18 of the first puck 12 and the first screen 36 covers the front opening 24. The first screen 36 is comprised of a mesh material to pass audible sounds through the first screen 36. A first diaphragm 37 is coupled to the back side 20 of the first puck 12 and the first diaphragm 37 covers the back opening 26.

A first control circuit 38 is provided and the first control circuit 38 is integrated into the first puck 12. The first control circuit 38 is electrically coupled to the first microphone 30 and the first control circuit 38 is electrically coupled to the first speaker 34. Furthermore, the first control circuit 38 may include signal amplification circuitry for amplifying an audio signal employed by the first speaker 34. A first transceiver 40 is integrated into the first puck 12, the first transceiver 40 is electrically coupled to the first control circuit 38 and the first transceiver 40 broadcasts a first communication signal. The first transceiver 40 may comprise a radio frequency transceiver or the like and the first transceiver 40 may employ Bluetooth communication protocols.

A first power supply 42 is integrated into the first puck 12 and the first power supply 42 is electrically coupled to the first control circuit 38. The first power supply 42 comprises a power port 44 that is recessed into the perimeter surface 22 of the first puck 12. The power port 44 is electrically coupled to the first control circuit 38 and the power port 44 receives a power cord 46 for supplying electrical power to the power port 44. The first power supply 42 includes a first induction coil 48 that is positioned in the interior of the first puck 12. The first induction coil 48 is electrically coupled to the power port 44 and the first induction coil 48 broadcasts a power signal.

A second puck 52 is provided and the second puck 52 is positionable on a second surface 54 of the partition 16. The second puck 52 has a forward side 56, a rear side 58 and a perimeter surface 60 extending between the forward side 56 and the rear side 58. The second puck 52 is substantially hollow, the forward side 56 has a forward opening 62 extending into an interior of the second puck 52 and the rear side 58 has a rear opening 64 extending into the interior of the second puck 52. The perimeter surface 60 of the second puck 52 has a groove 66 extending inwardly on the perimeter surface 60. The groove 66 extends around a full circumference of the perimeter surface 60 of the second puck 52 and the groove 66 is positioned adjacent to the forward side 56.

A cover 68 is removably positionable on the second puck 52 and the cover 68 is comprised of a fluid impermeable material to protect the second puck 52 from saliva from the second user 33 when the second user 33 speaks into the second puck 52. The cover 68 has a perimeter edge 70 and the perimeter edge 70 is continuously arcuate about a center point of the cover 68 such that the cover 68 has a circular shape. The perimeter edge 70 releasably engages the groove 66 for retaining the cover 68 on the second puck 52. Additionally, an elastomeric band may be integrated into the perimeter edge 70 to bias the perimeter edge 70 to engage the groove 66.

A plate 72 is coupled to the second puck 52 such that the plate 72 abuts the second surface 54 of the partition 16 when the second puck 52 is positioned against the second surface 54. The plate 72 is positioned on the rear side 58 and the plate 72 is continuous such that the plate 72 surrounds the rear opening 64. Additionally, the plate 72 is comprised of a ferromagnetic material such that the magnet 28 magnetically engages the plate 72 thereby retaining each of the first puck 12 and the second puck 52 on the partition 16.

A second microphone 74 is integrated into the second puck 52 to capture spoken words from a second user 33. The second microphone 74 is in remote communication with the first speaker 34 thereby facilitating the first speaker 34 to audibly emit words spoken by the second user 33. In this way the first user 32 can clearly hear with words spoken by the second user 33. The second microphone 74 is integrated into the forward side 56 of the second puck 52 and the second microphone 74 may comprise an electronic microphone or the like. A second diaphragm 75 is coupled to the rear side 58 of the second puck 52 and the second diaphragm 75 covers the rear opening 64.

A second speaker 76 is disposed in the second puck 52 to emit audible sounds outwardly from the second puck 52. The second speaker 76 is in remote communication with the first microphone 30 to audibly emit words spoken by the first user 32. The second speaker 76 is positioned in the interior of the second puck 52 and the second speaker 76 is directed toward the forward opening 62 in the forward side 56. In this way the second speaker 76 can emit audible sounds outwardly through the forward opening 62 thereby facilitating the second user 33 to hear the audible sounds. A second screen 78 is coupled to the forward side 56 of the second puck 52 and the second screen 78 covers the forward opening 62. The second screen 78 is comprised of a fluid permeable material to pass audible sounds through the second screen 78.

A second control circuit 80 is provided and the second control circuit 80 is integrated into the second puck 52. The second control circuit 80 is electrically coupled to the second microphone 74 and the second control circuit 80 is electrically coupled to the second speaker 76. The second speaker 76 may comprise an electronic speaker or the like. A second transceiver 82 is integrated into the second puck 52 and the second transceiver 82 is electrically coupled to the second control circuit 80. The second transceiver 82 may comprise a radio frequency transceiver or the like and the second transceiver 82 may employ Bluetooth communication protocols.

The second transceiver 82 broadcasts a second communication signal and the second transceiver 82 is in wireless communication with the first transceiver 40. The second transceiver 82 receives the first communication signal from the first transceiver 40 thereby facilitating the second speaker 76 to receive the spoken words captured by the first microphone 30. Furthermore, the first transceiver 40 receives the second communication signal from the second transceiver 82 thereby facilitating the first speaker 34 to receive the spoken words captured by the second microphone 74. A second induction coil 84 is positioned in the interior of the second puck 52 and the second induction coil 84 is electrically coupled to the second control circuit 80. Moreover, the second induction coil 84 receives the power signal from the first induction coil 48 for supplying electrical power to the second control circuit 80. Each of the first induction coil 48 and the second induction coil 84 may be electronic induction coils that can wirelessly transmit electrical energy.

In use, the first puck 12 is positioned against the first surface 14 of the partition 16 and the second puck 52 is positioned against the second surface 54 of the partition 16 such that the magnet 28 magnetically engages the plate 72 to retain the first puck 12 and the second puck 52 on the partition 16. The power cord 46 is plugged into the power port 44 such and the first induction coil 48 transmits electrical power to the second induction coil 84. The first user 32 speaks into the first microphone 30 and the second speaker 76 emits the words spoken by the first user 32. The second user 33 speaks into the second microphone 74 and the first speaker 34 emits the words spoken by the second user 33. In this way the first user 32 and the second user 33 can clearly communicate with each other through the partition 16.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A two way communication assembly for mounting on a partition thereby facilitating two individuals to verbally communication through the partition, said assembly comprising:

a first puck being positionable on a first surface of a partition;

a magnet being coupled to said first puck such that said magnet abuts the first surface of the partition when said first puck is positioned against the first surface;

a first microphone being integrated into said first puck wherein said first microphone is configured to capture spoken words from a first user;

a first speaker being disposed in said first puck wherein said first speaker is configured to emit audible sounds outwardly from said first puck;

a second puck being positionable on a second surface of the partition;

a cover being removably positionable on said second puck, said cover being comprised of a fluid impermeable material wherein said cover is configured to protect said second puck from saliva from the second user when the second user speaks into said second puck;

a plate being coupled to said second puck such that said plate abuts the second. surface of the partition when said second puck is positioned against the second surface;

a second microphone being integrated into said second puck wherein said second microphone is configured to capture spoken words from a second user, said second microphone being in remote communication with said first speaker wherein said first speaker is configured to audibly emit words spoken by the second user;

a second speaker being disposed in said second puck wherein said second speaker is configured to emit audible sounds outwardly from said second puck, said second speaker being in remote communication with said first microphone wherein said second sneaker is configured to audibly emit words spoken by the first user;

wherein said first puck has a front side, a back side and a perimeter surface extending between said front side and said back side, said first puck being substantially hollow, said front side having a front opening extending into an interior of said first puck, said back side having a back opening extending into said interior of said first puck; and wherein said magnet is positioned on said back side, said magnet being continuous such that said magnet surrounds said back opening.

2. The assembly according to claim 1, wherein:

said first speaker is positioned in said interior of said first puck, said first speaker being directed toward said front opening in said front side wherein said first speaker is configured to emit audible sounds outwardly through said front opening thereby facilitating the first user to hear the audible sounds; and said assembly includes a first screen being coupled to said front side of said first puck, said first screen covering said front opening, said first screen being comprised of a mesh material wherein said first screen is configured to pass audible sounds through said first screen.

3. The assembly according to claim 1, further comprising:

a first control circuit being integrated into said first puck, said first control circuit being electrically coupled to said first microphone, said first control circuit being electrically coupled to said first speaker; and a first transceiver being integrated into said first puck, said first transceiver being electrically coupled to said first control circuit, said first transceiver broadcasting a first communication signal.

4. The assembly according to claim 3, further comprising:

a second control circuit being integrated into said second puck, said second control circuit being electrically coupled to said second microphone, said second control circuit being electrically coupled to said second speaker; and a second transceiver being integrated into said second puck, said second transceiver being electrically coupled to said second control circuit, said second transceiver broadcasting a second communication signal, said second transceiver being in wireless communication with said first transceiver, said second transceiver receiving said first communication signal from said first transceiver thereby facilitating said second speaker to receive the spoken words captured by said first microphone, said first transceiver receiving said second communication signal from said second transceiver thereby facilitating said first speaker to receive the spoken words captured by said second microphone.

5. The assembly according to claim 4, further comprising:

a first induction coil being positioned in an interior of said first puck, said first induction coil broadcasting a power signal; and a second induction coil being positioned in said interior of said second puck, said. second induction coil being electrically coupled to said second control circuit, said second induction coil receiving said power signal from said first induction coil for supplying electrical power to said second control circuit.

6. The assembly according to claim 1, further comprising a first power supply being integrated into said first puck, said first power supply being electrically coupled to said first control circuit, said first power supply comprising:

a power port being recessed into said perimeter surface of said first puck, said power port being electrically coupled to said first control circuit, said power port receiving a power cord for supplying electrical power to said power port; and a first induction coil being positioned in said interior of said first puck, said first induction coil being electrically coupled to said power port, said first induction coil broadcasting a power signal.

7. The assembly according to claim 1, wherein:

said second puck has a forward side, a rear side and a perimeter surface extending between said forward side and said rear side, said second puck being substantially hollow, said forward side having a forward opening extending into an interior of said second puck, said rear side having a rear opening extending into said interior of said second puck; and said plate is positioned on said rear side, said plate being continuous such that said plate surrounds said rear opening, said plate being comprised of a ferromagnetic material such that said magnet magnetically engages said plate thereby retaining each of said first puck and said second puck on the partition.

8. The assembly according to claim 7, wherein:

said perimeter surface of said second puck has a groove extending inwardly mi said perimeter surface, said groove extending around a full circumference of said perimeter surface, said groove being positioned adjacent to said forward side; and said cover has a perimeter edge, said perimeter edge being continuously arcuate about a center point of said cover such that said cover has a circular shape, said perimeter edge releasably engaging said groove for retaining said cover on said second puck.

9. The assembly according to claim 7, wherein:

said second speaker is positioned in said interior of said second puck, said second speaker being directed toward said forward opening in said forward side wherein said second speaker is configured to emit audible sounds outwardly through said forward opening thereby facilitating the second user to hear the audible sounds; and said assembly includes a second screen being coupled to said forward side of said second puck, said second screen covering said second opening, said second screen being comprised of a fluid permeable material wherein said second screen is configured to pass audible sounds through said second screen.

10. A two way communication assembly for mounting on a partition thereby facilitating two individuals to verbally communication through the partition, said assembly comprising:

a first puck being positionable on a first surface of a partition, said first puck having a front side, a back side and a perimeter surface extending between said front side and said back side, said first puck being substantially hollow, said front side having a front opening extending into an interior of said first puck, said back side having a back opening extending into said interior of said first puck;

a magnet being coupled to said first puck such that said magnet abuts the first surface of the partition when said first puck is positioned against the first surface, said magnet being positioned on said back side, said magnet being continuous such that said magnet surrounds said back opening;

a first microphone being integrated into said first puck wherein said first microphone is configured to capture spoken words from a first user, said first microphone being integrated into said front side of said first puck;

a first speaker being disposed in said first puck wherein said first speaker is configured to emit audible sounds outwardly from said first puck, said first speaker being positioned in said interior of said first puck, said first speaker being directed toward said front opening in said front side wherein said first speaker is configured to emit audible sounds outwardly through said front opening thereby facilitating the first user to hear the audible sounds;

a first screen being coupled to said front side of said first puck, said first screen covering said front opening, said first screen being comprised of a mesh material wherein said first screen is configured to pass audible sounds through said first screen;

a first control circuit being integrated into said first puck, said first control circuit being electrically coupled to said first microphone, said first control circuit being electrically coupled to said first speaker;

a first transceiver being integrated into said first puck, said first transceiver being electrically coupled to said first control circuit, said first transceiver broadcasting a first communication signal; and a first power supply being integrated into said first puck, said first power supply being electrically coupled to said first control circuit, said first power supply comprising:

a power port being recessed into said perimeter surface of said first puck, said power port being electrically coupled to said first control circuit, said power port receiving a power cord for supplying electrical power to said power port; and a first induction coil being positioned in said interior of said first puck, said first induction coil being electrically coupled to said power port, said first induction coil broadcasting a power signal;

a second puck being positionable on a second surface of the partition, said second puck having a forward side, a rear side and a perimeter surface extending between said forward side and said rear side, said second puck being substantially hollow, said forward side having a forward opening extending into an interior of said second puck, said rear side having a rear opening extending into said interior of said second puck, said perimeter surface of said second puck having a groove extending inwardly on said perimeter surface, said groove extending around a full circumference of said perimeter surface, said groove being positioned adjacent to said forward side;

a cover being removably positionable on said second puck, said cover being comprised of a fluid impermeable material wherein said cover is configured to protect said second puck from saliva from the second user when the second user speaks into said second puck, said cover having a perimeter edge, said perimeter edge being continuously arcuate about a center point of said cover such that said cover has a circular shape, said perimeter edge releasably engaging said groove for retaining said cover on said second puck;

a plate being coupled to said second puck such that said plate abuts the second surface of the partition when said second puck is positioned against the second surface, said plate being positioned on said rear side, said plate being continuous such that said plate surrounds said rear opening, said plate being comprised of a ferromagnetic material such that said magnet magnetically engages said plate thereby retaining each of said first puck and said second puck on the partition;

a second microphone being integrated into said second puck wherein said second microphone is configured to capture spoken words from a second user, said second microphone being in remote communication with said first speaker Wherein said first speaker is configured to audibly emit words spoken by the second user, said second microphone being integrated into said forward side of said second puck;

a second speaker being disposed in said second puck wherein said second speaker is configured to emit audible sounds outwardly from said second puck, said second speaker being in remote communication with said first microphone wherein said second speaker is configured to audibly emit words spoken by the first user, said second speaker being positioned in said interior of said second puck, said second speaker being directed toward said forward opening in said forward side Wherein said second speaker is configured to emit audible sounds outwardly through said forward opening thereby facilitating the second user to hear the audible sounds;

a second screen being coupled to said forward side of said second puck, said second screen covering said second opening, said second screen being comprised of a fluid permeable material wherein said second screen is configured to pass audible sounds through said second screen;

a second control circuit being integrated into said second puck, said second control circuit being electrically coupled to said second microphone, said second control circuit being electrically coupled to said second speaker;

a second transceiver being integrated into said second puck, said second transceiver being electrically coupled to said second control circuit, said second transceiver broadcasting a second communication signal, said second transceiver being in wireless communication with said first transceiver, said second transceiver receiving said first communication signal from said first transceiver thereby facilitating said second speaker to receive the spoken words captured by said first microphone, said first transceiver receiving said second communication signal from said second transceiver thereby facilitating said first speaker to receive the spoken words captured by said second microphone; and a second induction coil being positioned in said interior of said second puck, said second induction coil being electrically coupled to said second control circuit, said second induction coil receiving said power signal from said first induction coil for supplying electrical power to said second control circuit.

* * * * *